US005593297A

United States Patent [19]

Nakajima et al.

[11] Patent Number: 5,593,297

[45] Date of Patent: Jan. 14, 1997

[54] SCROLL TYPE COMPRESSOR

[75] Inventors: Nobuyuki Nakajima; Masakuni Ishikawa; Norikatsu Kiso; Nobukazu Takagi; Yukio Kazahaya, all of Konan; Seiji Kuchiki, Ohra, all of Japan

[73] Assignees: Zexel Corporation, Tokyo; Tama Manufacturing Co., Ltd., Gunma, both of Japan

[21] Appl. No.: 491,378

[22] Filed: Jun. 16, 1995

[30] Foreign Application Priority Data

Jun. 16, 1994 [JP] Japan ..... 6-157987

[51] Int. Cl.[6] ..... F01C 21/04

[52] U.S. Cl. ..... 418/88; 418/94; 418/98; 418/151; 184/6.16

[58] Field of Search ..... 418/88, 94, 98, 418/151, 55.6; 184/6.16, 6.18

[56] References Cited

U.S. PATENT DOCUMENTS 4,828,466 5/1989 Kim ..... 418/94

5,263,822 11/1993 Fujio ..... 418/88

FOREIGN PATENT DOCUMENTS 580518 8/1958 Italy ..... 418/88

156190 7/1991 Japan ..... 418/88

*Primary Examiner*—Charles G. Freay

*Attorney, Agent, or Firm*— Wenderoth, Lind & Ponack

[57] ABSTRACT

In a scroll type compressor, a simple structure provides oil intake assistance to ensure that lubricating oil in an oil space is induced into a spiral groove in correspondence to the rotation rate of a drive shaft. The drive shaft is provided with an inclined spiral groove which is formed in the external circumferential surface of the drive shaft. The drive shaft slides in contact with a main bearing. A leading end of the spiral groove, in the direction of the rotation of the drive shaft, communicates with the oil space and a trailing end of the spiral groove opens into the lubricating oil reservoir. The lubricating oil is supplied to the area where the drive shaft slides in contact with the main bearing by the spiral groove. Also, upon rotation of the drive shaft, intake of lubricating oil into the spiral groove is assisted when the suction force is reduced due to a high rotation rate.

16 Claims, 9 Drawing Sheets

SCROLL TYPE COMPRESSOR

BACKGROUND OF THE INVENTION

1. Field of the Invention

The present invention relates to a scroll type compressor which is a coolant compressor used in a freezer or an air conditioner and is provided with a coil-like fixed scroll and an orbiting scroll that interlocks with the fixed scroll to form a scroll chamber, in which the volumetric capacity of the scroll chamber is varied with the orbiting motion of the orbiting scroll to compress the coolant.

2. Description of the Related Art

A scroll type compressor of the prior art is provided with a driving shaft that is rotated by a means for drive such as an electric motor, an orbiting scroll member which is mounted decentered (i.e. eccentrically) on the drive shaft and a fixed scroll member that interlocks with the orbiting scroll member to form a compression space (scroll chamber). The volumetric capacity of the scroll chamber is varied by orbiting the orbiting scroll member relative to the fixed scroll member to take in, compress and discharge the coolant. In this type of structure, the lubrication of the various sliding contact surfaces of the scroll type compressor is a crucial factor.

The scroll type compressor disclosed in Japanese Patent Unexamined Publication No. H3-149391 includes the main shaft oil groove 35 formed on an inclination on the external circumference of the main shaft 18 and in the surface where it slides in contact with the main bearing 19 as shown in FIGS. 2 through 4 of that publication. It also includes the swinging drive shaft oil groove 38 formed on an inclination on the external circumferential side surface of the swinging drive shaft 16 and on the surface where the decentered bearing 17 is in contact with the swinging drive shaft 16. An oil pump is mounted to this configuration. The main shaft oil groove 35 and the swinging drive shaft oil groove 38 deliver lubricating oil supplied by the oil pump to the sliding contact surfaces with the rotation of the drive shaft and the swinging motion of the swinging drive shaft. After lubrication, the oil is discharged into the balance weight chamber 36.

Also, Japanese Unexamined Patent Publication No. H4-47185 discloses a compressor provided with the oil groove 17 formed on an inclination on the external circumferential surface of the crank shaft 4 where it is in sliding contact with the bearing *9a*. With this compressor, lubricating oil supplied from the oil supply pipe 18 is taken in at the leading end of the oil groove 17 due to the rotation of the crank shaft 4 to lubricate the surface where it is in sliding contact with the bearing *9a*.

In addition, Japanese Unexamined Patent Publication No. H4-203377 discloses a compressor provided with a circumferential groove 21 formed on the external circumferential surface of the crank shaft 9 where it is in sliding contact with the lower bearing 11. At least one oil groove 19 is formed on an inclination extending from the circumferential groove 21. Lubricating oil supplied through an oil supply port 20 formed in the crank shaft 9 travels upward through the oil groove 19 due to the rotation of the crank shaft 9 to lubricate the surface where it is in sliding contact with the lower bearing 11.

However, although a compressor in which lubricating oil is supplied through an oil groove (spiral groove) has a sufficient capacity for supplying lubricating oil during low speed rotation, a sufficient supply of lubricating oil cannot be ensured during high speed rotation because the oil induction port is located toward the outside from the spiral groove and thus, centrifugal force becomes a factor during high speed rotation.

The example disclosed in Japanese Unexamined Patent Publication No. H3-149391 described above, attempts to solve this problem by mounting an oil pump (volumetric capacity pump). However, this creates many problems such as increased number of parts, difficulties in machining, high production costs and the like.

SUMMARY OF THE INVENTION

The object of the present invention is to provide a scroll type compressor which achieves sufficient supply of lubricating oil both at low speed and high speed rotation with a simple structure.

In order to achieve this object, the present invention is a scroll type compressor that comprises: a drive unit that is provided in a high pressure space within a sealed case, an orbiting shaft that is formed as a decentered extension of the drive shaft of the drive unit, an orbiting scroll member that orbits with the rotation of the drive shaft and is provided with an orbiting bearing that is mounted on the orbiting shaft, a block that is secured within the sealed case and is provided with a through hole that accommodates the main bearing, which, in turn, holds the drive shaft rotatably, a fixed scroll member that encloses the orbiting scroll between itself and the block in such a manner that the orbiting scroll can orbit freely, a lubricating oil reservoir formed in the upper portion of the block and an oil space formed below the main bearing that communicates with the lubricating oil reservoir. It is further provided with an inclined spiral groove formed in the external circumferential surface of the drive shaft in the area of sliding contact with the main bearing, the leading end of which, in the direction of the rotation of the drive shaft, opens into the oil space and the trailing end of which, opens into the lubricating oil reservoir, to supply lubricating oil to the area of sliding contact with the main bearing as the drive shaft rotates, and a means for intake assistance provided in the spiral groove for increasing the quantity of lubricating oil induced into the spiral groove from the oil space as the rotation rate of the drive shaft increases.

Alternatively, in place of the spiral groove mentioned above, the spiral groove may be formed on an inclination on the external circumferential surface of the drive shaft in the area of sliding contact with the main bearing, with the leading end in the direction of the rotation of the drive shaft opening into the oil space and the trailing end opening into the space formed by an oil cover, which encloses the range of rotation of the balance weight secured to the drive shaft.

The means for intake assistance should preferably be an oil induction hole that communicates between an orbiting space formed between the orbiting shaft and the orbiting bearing and the oil space. The intake port of the oil induction hole is formed within the spiral groove of the drive shaft.

Furthermore, when the spiral groove is formed on an inclination in the area of sliding contact with the main bearing with its leading end opening into the oil space and its trailing end opening into the lubricating oil reservoir, to supply lubricating oil to the area of sliding contact with the main bearing as the rotates, the means for intake assistance may include a centrifugal pump provided next to the trailing end of the spiral groove to take in lubricating oil from the spiral groove. This centrifugal pump may also include a radial groove formed in a disk that is fitted to the drive shaft at a specific distance from the block, which communicates between the trailing end of the spiral groove and an opening portion formed in the external circumferential surface of the disk. Or, it may be a circular groove formed in a disk which is fitted to the drive shaft at a specific distance from the block, which communicates with the trailing end of the spiral groove, and at least one radial groove that communicates between the circular groove and an opening portion formed in the external circumferential surface of the disk.

Moreover, when the spiral groove is formed on an inclination on the external circumferential surface of the drive shaft in the area of sliding contact with the main bearing, with its leading end opening into the oil space and its trailing end opening into the space formed by an oil cover which encloses the range of the rotation of the balance weight secured to the drive shaft, it is desirable to provide the centrifugal pump as a radial groove formed on the lower side surface of the balance weight secured to the drive shaft at a specific distance from the block and formed in the direction of the radius that communicates between the trailing end of the spiral groove and the opening portion formed in the external circumferential surface of the balance weight. This radial groove should be constituted with a radial hole provided with an opening portion formed in the external circumferential surface of the balance weight secured to the drive shaft at a specific distance from the block and a communicating hole that communicates between the end portion toward the center of the radial hole and the trailing end of the spiral groove in the direction of the rotation of the drive shaft.

Consequently, according to the present invention, the means for intake assistance increases the quantity of lubricating oil induced into the spiral groove from the oil space as the rotation rate of the drive shaft increases. The intake assistance means is provided in the spiral groove formed on an inclination in the external circumferential surface of the drive shaft in the area of sliding contact with the main bearing with its leading end opening into the oil space and its trailing end opening into the lubricating oil reservoir to supply lubricating oil to the area of sliding contact with the main bearing as the drive shaft rotates. The intake of lubricating oil into the spiral groove, where the suction force becomes reduced at high rotation rates, is assisted, in order to achieve the object described earlier. Also, if the spiral groove is formed on an inclination on the external circumferential side surface of the drive shaft in the area of sliding contact with the main bearing with its leading end opening into the oil space and its trailing end opening into the space formed by an oil cover which encloses the range of the rotation of the balance weight secured to the drive shaft, since the means for intake assistance for increasing the quantity of lubricating oil induced into the spiral groove from the oil space as the rotation rate of the drive shaft increases is provided to assist the intake of lubricating oil into the spiral groove whose suction force is reduced at high rotation rates, the object described above is achieved.

In addition, as the means for intake assistance, the intake port of the oil induction hole, which communicates between the oscillation space between the oscillating shaft and the oscillating bearing and the oil space, is formed at the leading end of the spiral groove to take in lubricating oil to the leading end of the spiral groove by taking advantage of the suction force with which lubricating oil is taken into the intake port of the oil induction hole, it ensures that a sufficient quantity of lubricating oil reaches the spiral groove. In addition, since the pressure difference between high pressure and low pressure increases during high speed rotation, increasing the quantity of lubricating oil taken into the oil induction port, the quantity of lubricating oil reaching the spiral groove can also be increased.

Furthermore, by providing a centrifugal pump next to the trailing end of the spiral groove as the means for intake assistance, the suction force of the spiral groove can be raised to ensure that a sufficient quantity of lubricating oil reaches the spiral groove. In addition, since the discharge outlet performance of the centrifugal pump increases during high speed rotation, the quantity of lubricating oil reaching the spiral groove is increased.

Additionally, if the centrifugal pump is formed with one radial groove formed on the lower side surface of a disk which is fitted to the drive shaft at a specific distance from the block with the groove end toward the center communicating with the trailing end of the spiral groove, a centrifugal pump with a simple structure is formed that adds suction force to the spiral groove. Also, if the centrifugal pump is formed with at least one radial groove on the lower side surface of a disk that is fitted to the drive shaft at a specific distance from the block and a circular groove formed in the lower side surface of the disk, to which the end of the radial groove toward the center communicates and to which also the trailing end of the spiral groove communicates, a centrifugal pump with a simple structure is formed that adds suction force to the spiral groove with stability.

In addition, if the centrifugal pump is formed with a radial groove in the direction of the radius on the lower side surface of a balance weight secured to the drive shaft at a specific distance from the block with its end towards the center communicating with the trailing end of the spiral groove, or if the centrifugal pump is constituted with a radial hole formed in the direction of the radius of the balance weight secured to the drive shaft at a specific distance from the block and a communicating hole that communicates between the end of the radial hole toward the center and the trailing end of the spiral groove, a centrifugal pump is formed without requiring the disk described earlier, making it possible to reduce the number of parts.

BRIEF DESCRIPTION OF THE DRAWINGS

The above and other features of the invention and the concomitant advantages will be better understood and appreciated by persons skilled in the field to which the invention pertains in view of the following description given in conjunction with the accompanying drawings which illustrate preferred embodiments. In the drawings.

DETAILED DESCRIPTION OF THE PREFERRED EMBODIMENTS

The following is an explanation of embodiments according to the present invention in reference to the drawings.

Figure 1:
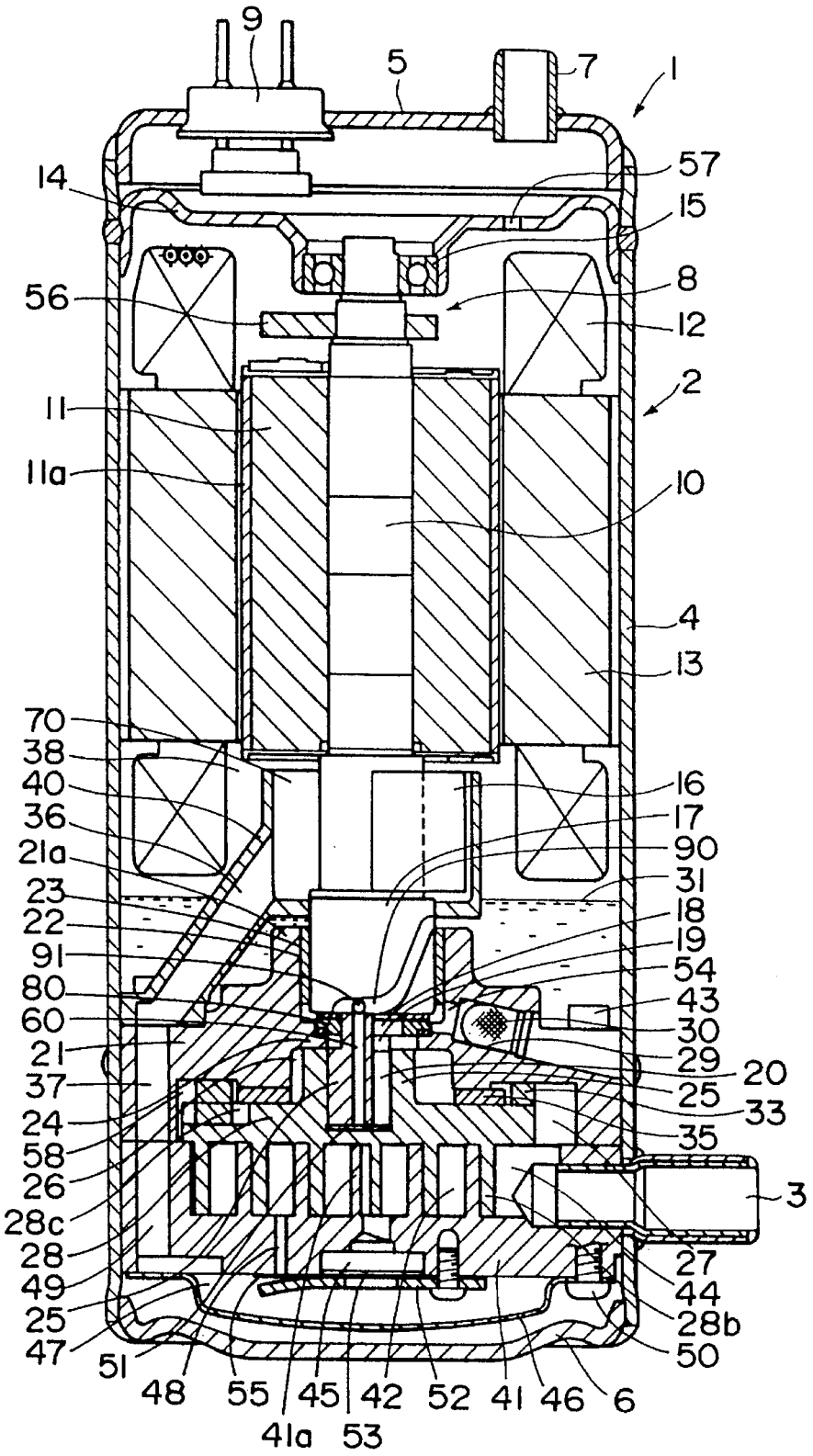
FIG. 1 is a cross section illustrating an overall structure of a scroll type compressor according to a first embodiment of the present invention.

First, the basic structure of the scroll type compressor in an embodiment according to the present invention is explained in reference to the overall cross section shown in FIG. 1. In this scroll type compressor 1, a sealed case 2 is structured with a cylindrical case 4 that is provided with a coolant intake port 3 at its side, a cap member 5 that seals the upper end of the cylindrical case 4, and a base member 6 that seals the lower end of the cylindrical case 4. Note that the cap member 5 is provided with a coolant outlet port 7 and a power supply terminal 9 for the drive unit (electric motor 8) to be explained below.

The drive unit 8 may be, for example, a brushless DC electric motor. The drive unit 8 in this embodiment is provided with a drive shaft 10, a rotor 11, which is secured onto the drive shaft 10 and which is surrounded by a permanent magnet 11*a* and a stator 13, which is secured onto the internal circumferential surface of the cylindrical case 4 in the surrounding area of the rotor 11 and is wrapped by a coil winding 12.

The upper end of the drive shaft 10 is rotatably held by a drive shaft holding member 14 via a bearing 15. A sub-balance weight 56 is secured onto the upper portion of the rotor 11 and a main balance weight 16 is secured to the lower portion of the rotor 11. Note that a plurality of coolant transfer holes 57 are formed in the drive shaft holding member 14 at specific positions and that the circumferential edge of the drive shaft holding member 14 is secured to the internal circumferential surface of the cylindrical case 4 with means for securing such as plug welding.

A main shaft (part of the drive shaft) 17 which is formed to have a larger diameter than the drive shaft is formed at the lower end of the drive shaft 10. Under this main shaft 17, a bearing mounting portion (part of the drive shaft) 18 which is formed to have a smaller diameter than the main shaft 17, a neck portion (part of the drive shaft) 19 decentered from the bearing mounting portion 18 and an orbiting shaft (part of the drive shaft formed eccentrically from the drive shaft) 20 extending from the neck portion 19, are formed as a unit so that the orbiting shaft 20 makes a swinging movement when the drive shaft 10 rotates. The main shaft 17 is supported by a main bearing 23 which is fitted in a bearing hole 22 formed by passing through the center of a block 21, to be explained later. A a spiral groove 90 is formed in the external circumferential surface of the main shaft 17 where it is in contact with the main bearing 23 on an inclination relative to the direction of the rotation, to impart a pumping effect when the main shaft 17 rotates.

The block 21 is secured to the internal circumferential surface of the cylindrical case 4 by, for example, plug welding. A cylindrical bearing portion 21*a* is formed at the center of the block and includes a bearing hole 22 formed in bearing portion 21*a*. At the lower end of the bearing hole 22, a support flange portion 24 is formed in order to reduce the diameter of the opening through the block. Under the support flange portion 24 a bearing space 26, the diameter of which is formed large enough so that an orbiting bearing 25, to be explained below, can orbit. Under the bearing space 26, a space 27 is formed, where an orbiting scroll member 28, to be explained below, can orbit. The orbiting referred to here indicates an orbiting motion that does not include self rotation.

In addition, in the lower side portion of the bearing hole 22, an oil intake hole 29 is formed into which a filter 30 is fitted. The oil intake hole 29 is formed in such a manner that it inclines downwardly from the lower side of the bearing hole 22 toward the outside in the direction of the radius so that it communicates with a lubricating oil reservoir 31 formed in the lower portion of a space (high pressure space) 38 where the drive unit 8 is provided. With this, even if the lubricating oil level in the lubricating oil reservoir 31 becomes low, sufficient lubrication is assured at a lower fluid level than with an arrangement in which the oil intake hole 29 is formed horizontally.

A circular oldham's ring housing groove 58 is formed in the lower end surface of the block 21 and a coolant passage 37 is formed that passes through the block 21. In addition, a circular oldham's ring 33 which is provided with tab portions protruding up and down is housed in the oldham's ring housing groove 58. In the oldham's ring housing groove 58, a block side oldham's ring groove (not shown) is formed of a specific length. The tab of the oldham's ring 33, which protrudes out toward the block can be inserted in such a manner that it can slide freely. Note that a thrust bearing 35 is provided at the lower end of the block 21 where the oscillating scroll member, to be explained below, slides in contact with it.

In addition, a circular seal bearing 80 is provided at the lower end of the support flange portion 24 and the main shaft 17. This seal bearing 80 constitutes a pressure barrier between the bearing space 26 and the space (oil space) 54 which communicates with the oil intake hole 29, the seal bearing 80 holding the drive shaft 10 rotatably. Note that between the upper surface of the seal bearing 80 and the lower end of the main shaft 17, a seal washer 81, whose two side surfaces are polished to a specific surface roughness, is provided (see FIG. 2) and between the upper surface of the seal bearing 80 and the support flange portion 24 of the block 21, an inclination-absorbing ring 82 comprising an elastic member such as synthetic rubber or synthetic resin is provided (see FIG. 2).

Since the seal washer 81 is provided, the process for polishing the end of the main shaft 17 can be eliminated and also, since the inclination-absorbing ring 82 is provided, the inclination of the drive shaft 10 caused by the force applied to the drive shaft 10 by the oscillating scroll member 28 can be absorbed, making it possible to improve the seal between the support flange portion 24 and the seal bearing 80.

An oil cover 40 is provided at the upper end of the block 21. The oil cover 40 is constructed by forming, as a unit, a peripheral wall enclosing the range of rotation (rotation space) 70 of the balance weight 16, a bottom portion which blocks off the lower end of the peripheral wall and is provided with a through hole through which the main shaft 17 passes and a leg portion that supports the peripheral wall and the bottom portion. The material to be used for forming the oil cover, such as synthetic resin, metal etc., is not restricted. Note that a coolant outlet passage 36 which communicates with the coolant passage 37 is formed in one of the legs of the leg portion.

The orbiting scroll member 28 is provided with an bearing 25 which extends from the center of one of the side surfaces of a disk-shaped body of the orbiting scroll member 28 and into which the orbiting shaft 20 is inserted for rotation therein. An orbiting scroll 28*b* formed as a coil on the side surface opposite the surface where the bearing 25 is formed. The scroll member 8 is further provided with an orbiting scroll-side oldham's ring groove 28*c* into which the tab of the oldham's ring 33 protruding out toward the orbiting scroll is inserted in such a manner that it can slide freely. The tab is formed on the side surface toward the bearing 25. Note that the bearing space 51 is formed by inserting the orbiting shaft 20 into the bearing 25 and communicates with the oil space 54 via an oil induction hole 60.

The fixed scroll member 41 is provided with a coil-like fixed scroll 41*a* which forms, a scroll chamber (compression space) 42 by interlocking with the orbiting scroll 28*b*, and is secured to the block 21 with a bolt 43 so that it contains the orbiting scroll member 28 in such a manner that the orbiting scroll member 28 can orbit freely. At the side of the fixed scroll member 41, an intake chamber 44 is provided which communicates with both the coolant intake port 3 and the upstream side of the scroll chamber 42. An outlet hole 45, formed at the center of the fixed scroll member 41, communicates with the downstream side of the scroll chamber 42.

The outlet hole 45 opens into an outlet space 47 which is formed by a cover 46 that covers the lower end surface of the fixed scroll member 41. The outlet space 47 communicates with an outlet passage 49 passing through the fixed scroll member 41. Note that the cover 46 is secured to the lower end surface of the fixed scroll member 51 with a bolt 50.

A bypass passage 48, which communicates between the middle portion of the scroll chamber 42 and the outlet space 47, is formed in the fixed scroll member 41. A relief valve 55 is provided at the opening portion of the bypass passage 48 towards the outlet space. With this, if the pressure in the scroll chamber 42 exceeds a specific level, the relief valve 55 opens so that the pressure in the scroll chamber 42 is released into the outlet space 47. Also, at the outlet hole 45, a check valve 53 is held by a check valve retainer 52 to prevent high pressure backing up from the outlet space 47.

When the electric motor 8, which functions as the drive unit, is driven in a scroll type compressor 1 structured as described above, the orbiting scroll member 28, mounted to the drive shaft 10 of the electric motor 8 by decentering, makes an orbiting motion relative to the fixed scroll member 41 and the volumetric capacity of the scroll chamber 42, constituted by the orbiting scroll 28*b* and the fixed scroll 41*a*, changes, thereby performing intake, compression and outlet in sequence.

With this, the coolant is drawn in through the coolant intake port 3, and taken in from the intake chamber 44 to be compressed in the scroll chamber 42. It then travels from the outlet hole 45 through the outlet space 47, the outlet passage 49, the coolant passage 37 and the coolant outlet passage 36 to reach the space (high pressure space) 38, where the electric motor 8 is provided. From here, it is discharged via the coolant outlet port 7 to be sent to the next process.

In addition, the lubricating oil that comes from the lubricating oil reservoir 31 via the oil intake hole 29 to reach the oil space 54, on the one hand, travels to the oil induction hole 60, the bearing space 51, the sliding contact surface between the orbiting shaft 20 and the bearing 25, the bearing space 26, the thrust bearing 35 and the intake chamber 44 due to the pressure difference between the high pressure in the high pressure space 38 and the low pressure in the intake chamber 44, and then, along with the coolant, travels to the high pressure chamber 38 via the scroll chamber 42, the outlet hole 45, the outlet space 47 and the passages 49, 37 and 36. There, it becomes separated from the high pressure coolant due to the action of the rotor 11 and returns to the lubricating oil reservoir 31 (first lubricating oil path). On the other hand, the lubricating oil that is taken into the spiral groove 90 goes up the sliding contact surface with the main bearing 23 along the spiral groove 90 to lubricate that area. It then returns to the lubricating oil reservoir 31 from the trailing end of the spiral groove 90 via the gap between the oil cover 40 and the block 21 (second lubricating oil path).

This means that the main bearing 23 is lubricated separately from the bearing 25 and the thrust bearing 35 and that the hot lubricating oil, heated by lubricating the main bearing 23, is not used to lubricate the bearing 25 and the thrust bearing 35, achieving an improvement in the durability of the lubricating oil.

Figure 10:
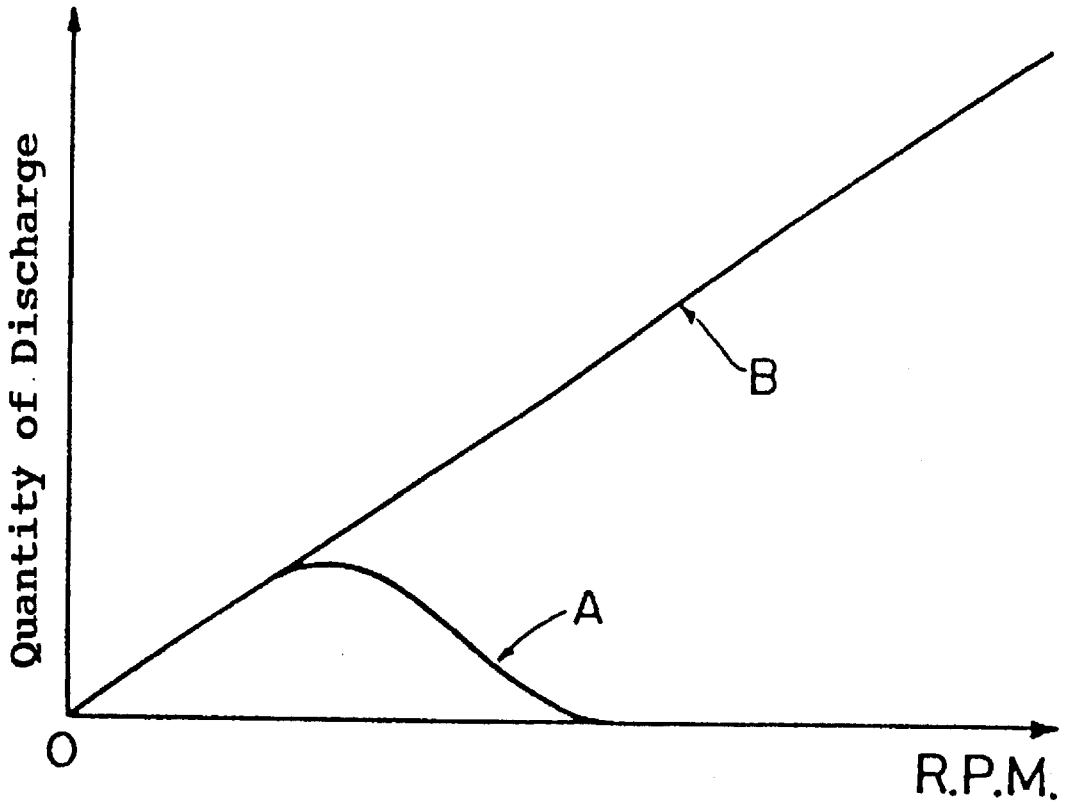
FIG. 10 is a characteristics diagram showing the relationship between the discharge quantity and the rotation rate with and without the spiral groove.

In the scroll-type compressor structured as described above, when the rotation of the drive shaft 10 reaches high speeds, there is a problem in that lubricating oil does not easily enter the spiral groove since the velocity of the spiral groove 90 is high. For instance, as indicated with the characteristics curve A in FIG. 10, the discharge quantity resulting from the pump effect created in the spiral groove 90 becomes reduced when the rotation rate of the drive shaft 10 reaches or exceeds a specific rotation rate.

Figure 2:
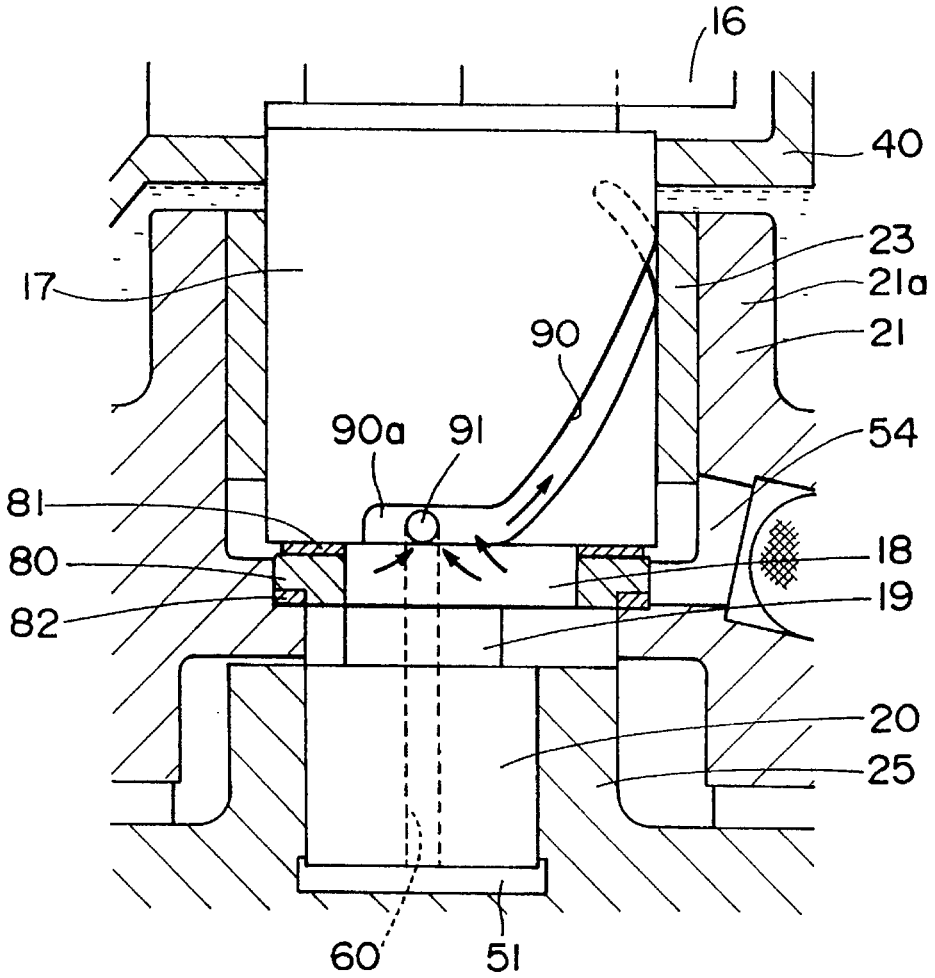
FIG. 2 is a partial enlargement illustrating the structure of the spiral groove in the first embodiment of the present invention.

Because of this, as shown in FIG. 1, and in FIG. 2 in more detail, an extension groove 90*a*, is provided, which is formed by extending the leading end of the spiral groove 90 which opens into the oil space 54 in the direction of the rotation of the drive shaft by a specific length along the external circumference of the drive shaft. In addition, an intake port 91 of the aforementioned oil induction hole 60 is formed at a specific position in the extension groove 90*a*. This causes the lubricating oil to travel in the direction in which it is taken into the oil induction hole 60 due to the pressure difference between the high pressure and the low pressure areas, as indicated with the arrow in FIG. 2, to be taken into the extension groove 90*a*.

As a result, the lubricating oil taken into the extension groove 90*a* reaches the first lubricating oil path which extends from the intake port 91 to the oil induction hole 60 on the one hand, and also moves upward along the spiral groove 90 from the extension groove 90*a* on the other hand, ensuring that lubricating oil is reliably induced into the spiral groove 90. In addition, since an increase in the rotation rate of the drive shaft 10 causes a pressure increase in the high pressure area, the quantity of lubricating oil taken into the oil induction hole 60 also increases during high speed rotation. This means that the quantity of lubricating oil going up the spiral groove 90 increases in correspondence to an increase in the rotation rate, as indicated by the characteristics curve B in FIG. 10. This makes it possible to constitute a means for intake assistance which ensures that the lubricating oil in the oil space 54 is induced to the spiral groove 90 in proportion to the rotation rate of the drive shaft 10.

Figure 3:
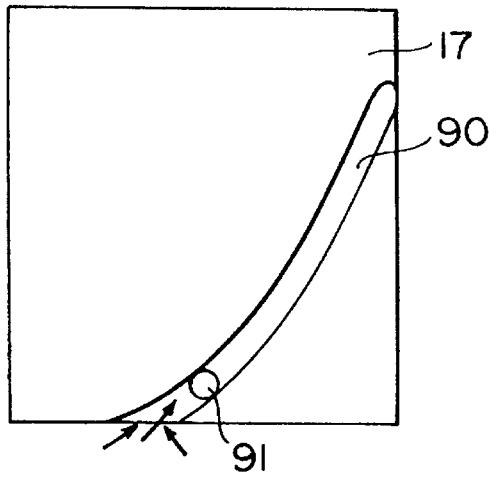
FIG. 3 is a partial enlargement illustrating the structure of a second spiral groove in another embodiment of the present invention.

Furthermore, FIG. 3 shows an embodiment with another structure, different from the embodiment described above. This particular embodiment features an intake hole 91 formed inside the spiral groove 90 in the vicinity of the leading end of the spiral groove 90 in the direction of the rotation of the drive shaft. Compared with the previous embodiment, this embodiment has a special advantage in that it is not necessary to form the extension groove 90*a* described earlier.

Figure 4A:
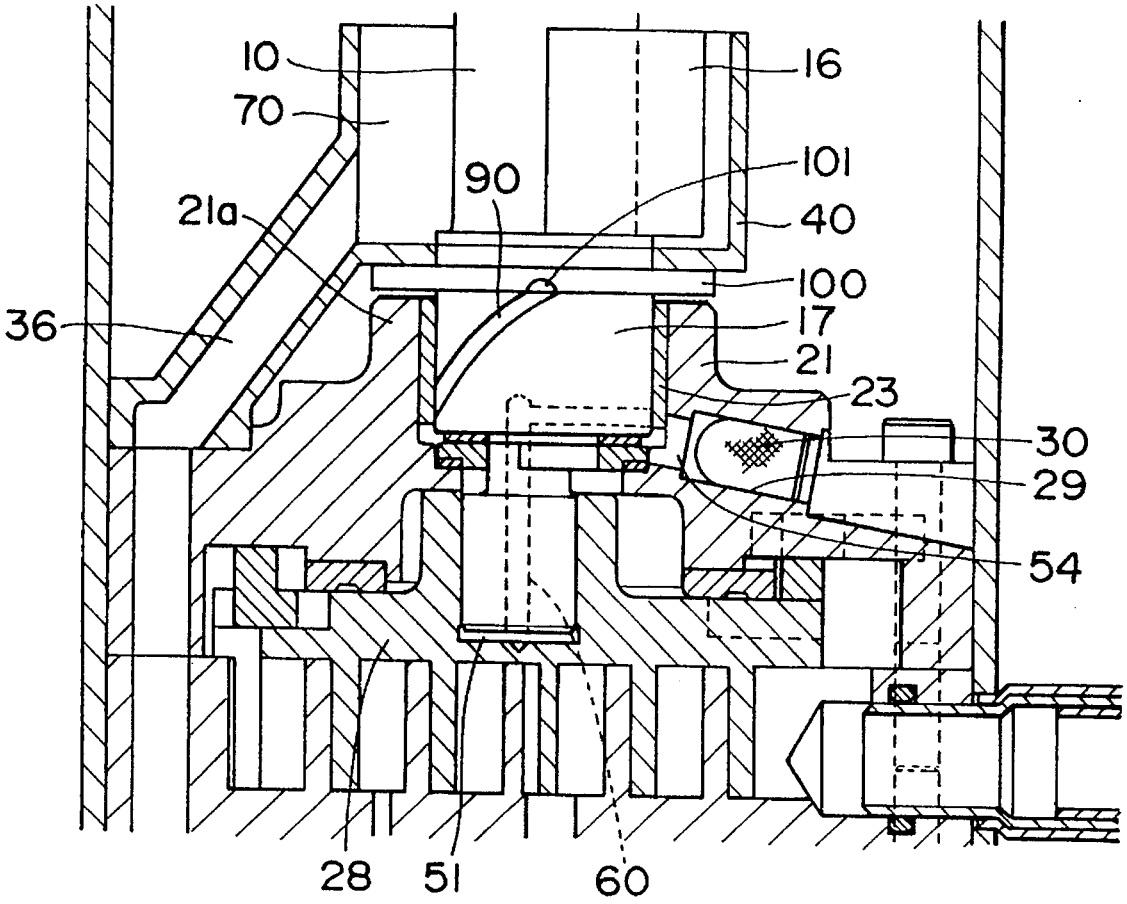
FIG. 4A is a partial enlarged cross section illustrating the structure of a centrifugal pump in a third embodiment of the present invention and FIG. 4B is a partial cross section.
Figure 4B:
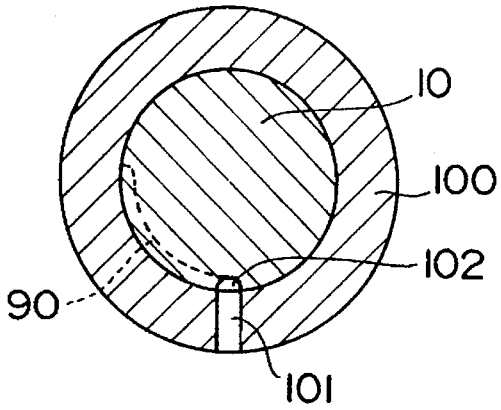

FIGS. 4*a* and 4*b* show another embodiment of the means for intake assistance, which features a centrifugal pump formed toward the trailing end of the spiral groove 90. The centrifugal pump is formed between the oil cover 40 and the upper end of the block 21 and is constituted with a disk 100 fitted so as to leave a very small clearance between itself and the upper end portion of the bearing portion 21*a*. On the bottom side surface of the disk 100, toward the block, a radial groove 101 is formed in the direction of the radius, and also a communicating groove 102 that communicates between the end portion of the radial groove 101 toward the center and the trailing end portion of the spiral groove 90 is formed.

This practically blocks off the opening portion on the side of the radial groove 101 with the upper end portion of the bearing portion 21*a*, giving the form of a pipe to the radial groove 101, to function as a centrifugal pump when the disk 100 rotates. Note that while, in this embodiment, the radial groove 101 is formed in the direction of the radius of the disk 100, the radial groove may take any form as long as it communicates between the trailing end of the spiral groove 90 and the opening portion of the disk 100 formed in the external circumferential surface and, in particular, as long as it is located toward the rear in the direction of the rotation of the disk 100 relative to the position of the trailing end of the spiral groove 90 in the direction of the radius.

Consequently, in this centrifugal pump, when the disk 100 rotates along with the drive shaft 10, lubricating oil goes up along the spiral groove 90 to reach the radial groove 101 via the communicating groove 102 and is then expelled from the radial groove 101 because of the centrifugal force. This causes a negative pressure at the trailing end of the spiral groove 90, i.e., the spiral groove 90 obtains a suction force.

Moreover, since the centrifugal force working in the centrifugal pump increases as the rotation rate of the drive shaft 10 increases, the negative pressure at the trailing end of the spiral groove 90 also increases, along with any increase in the rotation rate. This means that the suction force of the spiral groove 90 is increased in correspondence to increases in the rotation rate.

This makes it possible to achieve a pump effect in the spiral groove 90 which works with a high degree of efficiency at low speeds, when the centrifugal force working in the centrifugal pump is small, and to assist the spiral groove with the pump effect of the centrifugal pump whose suction force has increased due to an increase in the centrifugal force during high speed rotation, when the efficiency of the pump effect in the spiral groove 90 is reduced, achieving an efficient supply of lubricating oil which corresponds to the rotation rate.

Figure 5A:
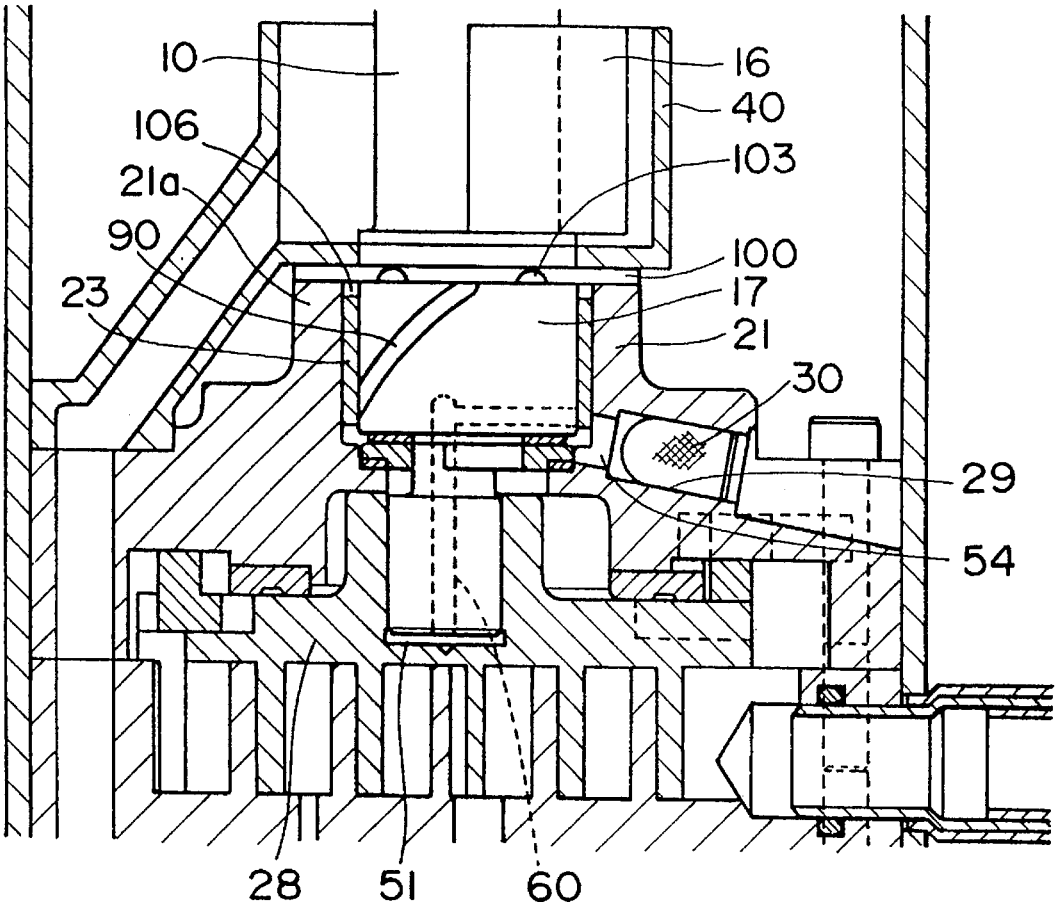
FIG. 5A is an enlarged partial cross section illustrating the structure of a fourth centrifugal pump in another embodiment according to the present invention and FIG. 5B is a partial cross section.
Figure 5B:
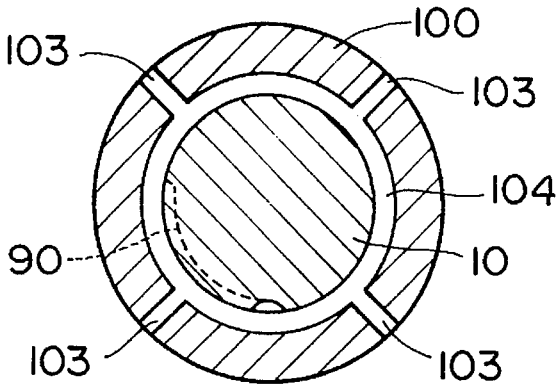

Another embodiment of the centrifugal pump shown in FIG. 5 features a plurality of radial grooves 103 formed in the bottom side portion of the disk 100 toward the block and a circular groove 104 which communicates between the ends of the radial grooves 103 toward the center. The disk 100 is secured to the drive shaft 10 in such a manner that there is a very small clearance between the disk 100 and the upper end portion of the bearing portion 21*a* and the opening portions of the radial grooves 103 at the side are practically blocked off with the upper end portion of the bearing portion 21*a* to achieve a pipe form.

Moreover, in this embodiment, the length of the main bearing 23 in the direction of the axis is made smaller compared with the preceding embodiment and an oil reservoir 106 is constituted with the upper end portion of the main bearing 23, the bearing hole 22 of the block 21, the main shaft 17 and the disk 100. A circular groove 104 formed in the disk 100 faces opposite the upper portion of the oil reservoir 106, and the trailing end of the spiral groove 90 communicates with the oil reservoir 106.

This causes the lubricating oil in the radial grooves 103 to be expelled from the radial grooves 103, to which an outward force is applied when the disk 100 rotates with the rotation of the drive shaft 10 due to centrifugal force. As a result, the pressure inside the circular groove 104 and the oil reservoir 106 becomes negative, which in turn causes the pressure at the trailing end of the spiral groove 90 to become negative. Thus, the suction force of the spiral groove 90 increases due to the negative pressure. Note that in this embodiment, too, the radial grooves 103 may take any form as long as they communicate between the trailing end of the spiral groove 90 and the opening portion of the disk 100 formed in the external circumferential surface and, in particular, as long as the aforementioned opening portion is located toward the rear in the direction of the rotation of the disk 100 relative to the position of the trailing end of the spiral groove 90 in the direction of the radius, as in the case of the radial groove in the previous embodiment.

As has been explained, in this embodiment, as in the preceding embodiment, since the centrifugal force working in the centrifugal pump increases as the rotation rate of the drive shaft 10 increases, the negative pressure at the trailing end of the spiral groove 90 also increases, along with any increase in the rotation rate. This means that the suction force of the spiral groove 90 is increased in correspondence to increases in the rotation rate. This makes it possible to impart a pump effect to the spiral groove 90, which works with a high degree of efficiency at low speeds, when the centrifugal force working on the centrifugal pump is small, and to assist the spiral groove with the pump effect of the centrifugal pump whose suction force has increased due to an increase in the centrifugal force during high speed rotation when the efficiency with which the pump effect of the spiral groove 90 is reduced, achieving an efficient supply of lubricating oil which corresponds to the rotation rate.

In the embodiments described above, since an upward force is applied to the disk 100 at a specific pressure by the lubricating oil passing through the radial grooves 101, 103 formed in the bottom side surface, or by the lubricating oil which permeates the small clearance between the disk 100 and the upper end portion of the bearing portion 21*a*, it is necessary to secure the disk 100 to the drive shaft 10 with a specific strength. To achieve this a groove with specific protrusions and indentations may be formed around the circumference of the drive shaft 10 to secure the disk 100 to the drive shaft 10 by fitting the internal circumference of the disk 100 into this groove.

Figure 6:
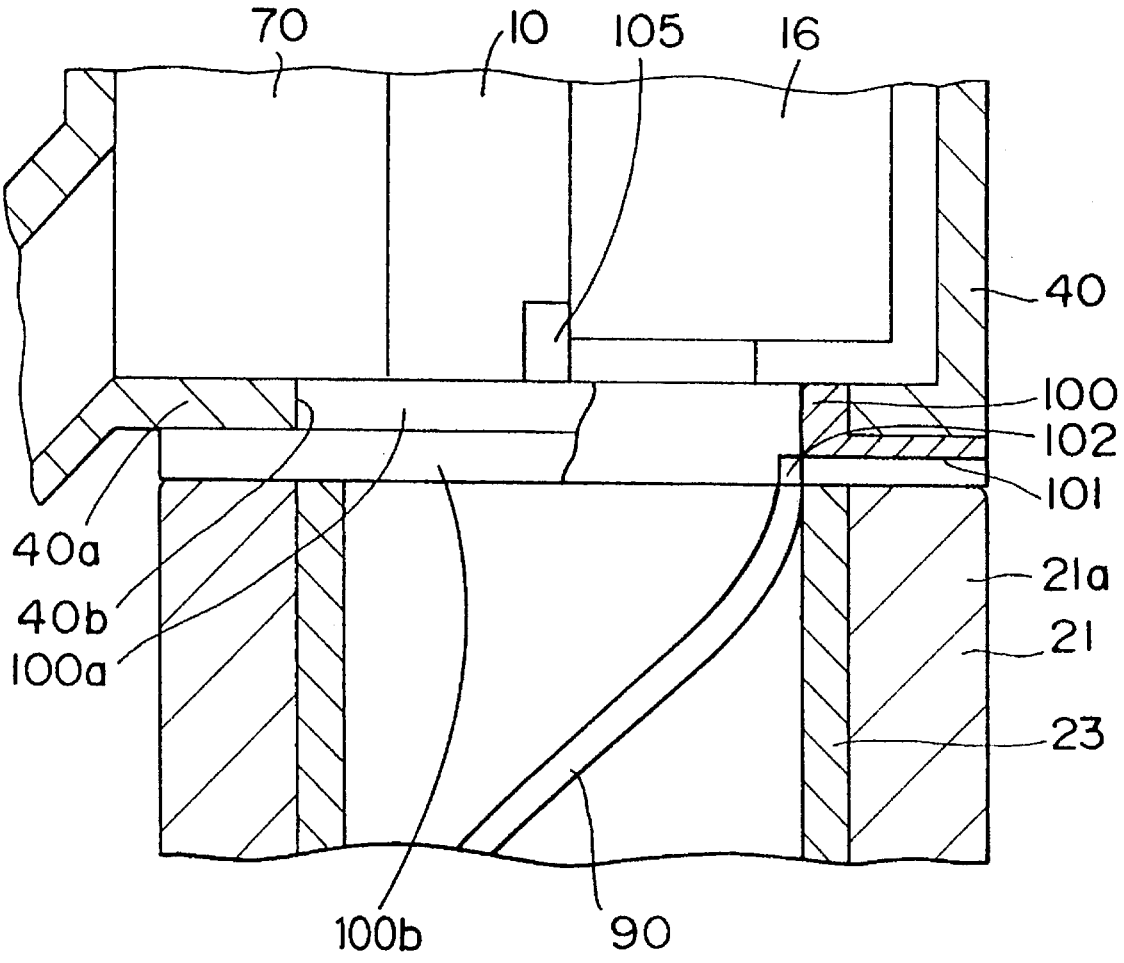
FIG. 6 is an enlarged partial cross section showing how the disk is held the fourth embodiment according to the present invention.

Alternatively, as shown in FIG. 6, the diameter of the through hole 40*b* formed in the bottom portion 40*a* of the oil cover 40 can be made larger than the diameter of the drive shaft 10 while constituting the disk 100 with an inner disk 100*a*, which has an external diameter approximately equal to the internal diameter of the through hole 40*b* formed in the oil cover 40 and which is inserted in the through hole 40*b* so as to block off the through hole 40*b*, and an outer disk 100*b* provided with an upper side surface that slides in contact with the bottom portion 40*a* of the oil cover and a bottom side surface where the communicating hole 102 and the radial groove 101 are formed.

With this, since the upward force applied to the disk 100 is received by the bottom portion 40*a* of the oil cover 40, the disk can be prevented from floating. Note that retaining the disk 100 in the direction of the rotation may be implemented by securing a pin 105 to the end of the balance weight 16 as shown in FIG. 6.

Figure 7:
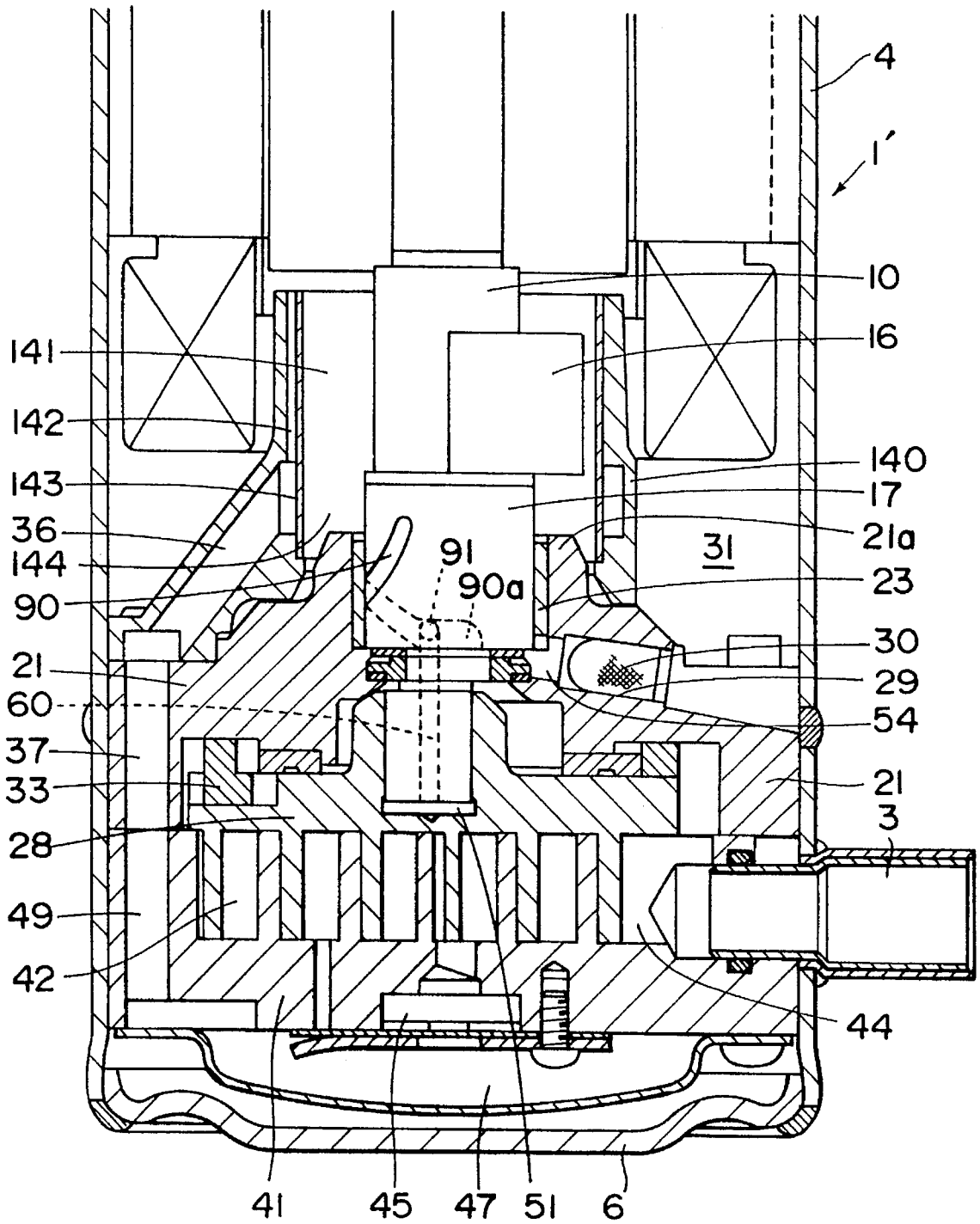
FIG. 7 is a partially enlarged cross section showing a scroll type compressor with a different structure in a fifth embodiment according to the present invention.

The scroll type compressor 1 shown in FIG. 7 features a different structure in the area of the oil cover from that of the scroll type compressor 1 that has been explained so far. In the scroll type compressor 1, the oil cover 140 is provided surrounding the range of the rotation of the balance weight 16 starting from the upper end portion of the bearing portion 21*a* and the trailing end of the spiral groove 90 in the direction of the rotation of the drive shaft opens into the rotation space 141 of the balance weight 16. Also, a cylindrical partitioning wall 143 is erected on the internal circumferential surface of the oil cover 140 and a coolant passage 142 is formed between the partitioning wall 143 and the oil cover 140. In addition, an inner lubricating oil reservoir 144 which communicates with the lubricating oil reservoir 31 described earlier, via the clearance at the surface where the oil cover 140 is in contact with the block 21, is formed in the lower portion of the rotation space 141.

In this type of scroll type compressor 1, as in the case of the scroll type compressor 1 explained earlier, an extension groove 90*a* is provided, which is formed by extending the leading end of the spiral groove 90 which opens into the oil space 54 in the direction of the rotation of the drive shaft by a specific length along the external circumference of the drive shaft. In addition, an intake port 91 for the aforementioned oil induction hole 60 is formed at a specific position in the extension groove 90*a*. This causes the lubricating oil to travel in the direction in which it is taken into the oil induction hole 60 due to the pressure difference between the high pressure and the low pressure areas, to be taken into the extension groove 90*a*.

As a result, the lubricating oil taken into the extension groove 90*a* reaches the first lubricating oil path which extends from the intake port 91 to the oil induction hole 60 on the one hand, and also moves upward along the spiral groove 90 from the extension groove 90*a* on the other hand, ensuring that lubricating oil is reliably induced into the spiral groove 90. In addition, since an increase in the rotation rate of the drive shaft 10 causes the pressure in the high pressure area to increase, the quantity of lubricating oil taken into the oil induction hole 60 also increases during high speed rotation. This means that the quantity of lubricating oil going up the spiral groove 90 increases in correspondence to increases in the rotation rate, as indicated by the characteristics curve B in FIG. 10. All this makes it possible to constitute a means for intake assistance which ensures that the lubricating oil in the oil space 54 is induced to the spiral groove 90 in proportion to the rotation rate of the drive shaft 10.

Figure 8A:
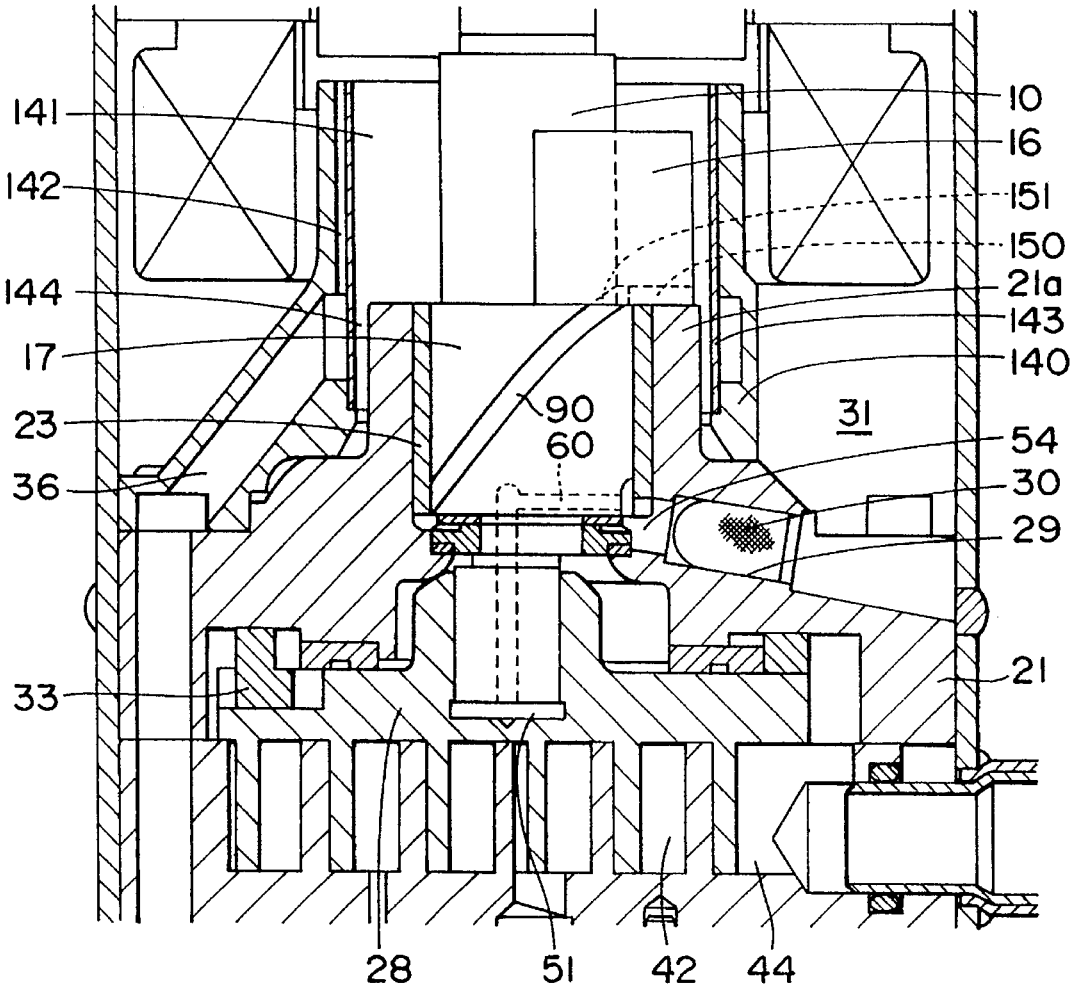
FIG. 8A is an enlarged partial cross section showing the structure of a centrifugal pump mounted in a scroll type compressor with a different structure according to a sixth embodiment of the present invention and FIG. 8B is a partial cross section.
Figure 8B:
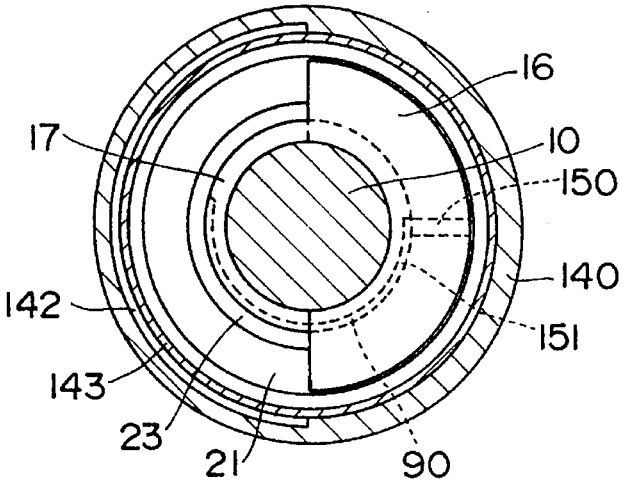

FIGS. 8A and 8B show the scroll type compressor 1 provided with a centrifugal pump toward the trailing end of the spiral groove 90 as the means for intake assistance. This centrifugal pump is constituted by securing the balance weight 16 which is provided with a radial groove 150 formed on the lower side surface in the direction of the radius and a communicating groove 151, which communicates between the radial groove 150 and the trailing end of the spiral groove 90, to the drive shaft in such a manner that there is a small clearance between the lower end portion of the balance weight 16 and the upper end portion of the bearing portion 21*a*. In other words, the centrifugal pump is formed by securing the balance weight 16 to the drive shaft 10 in such a manner that the radial groove 150 is blocked off by the upper end portion of the block to impose upon it a pipe-like form.

With this, when the drive shaft 10 rotates to rotate the balance weight 16, an outward force is applied to the lubricating oil inside the radial groove 150 due to centrifugal force, to be discharged into the inner lubricating oil reservoir 144. As a result, the pressure in the communicating groove 151 and at the trailing end of the spiral groove 90 becomes negative to assist in the suction force of the spiral groove 90. In addition, the discharge force (centrifugal force) of the radial groove 150 increases as the rotation rate of the drive shaft 10 increases. Consequently, the negative pressure at the trailing end of the spiral groove 90 also increases, increasing the suction force of the spiral groove 90.

Figure 9A:
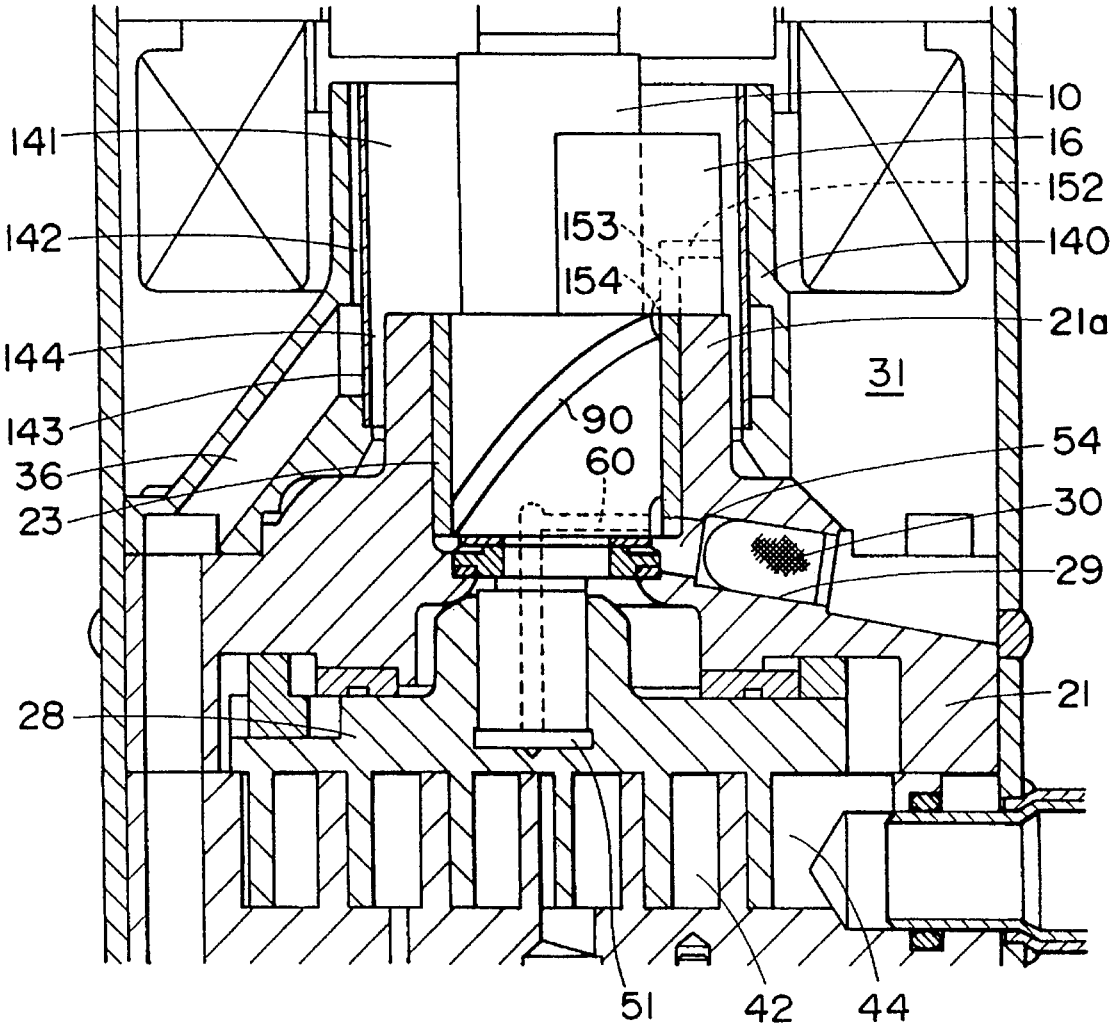
FIG. 9A is an enlarged partial cross section showing the structure of another centrifugal pump mounted in a scroll type compressor with a different structure according to a seventh embodiment of the present invention and FIG. 9B is a partial cross section.
Figure 9B:
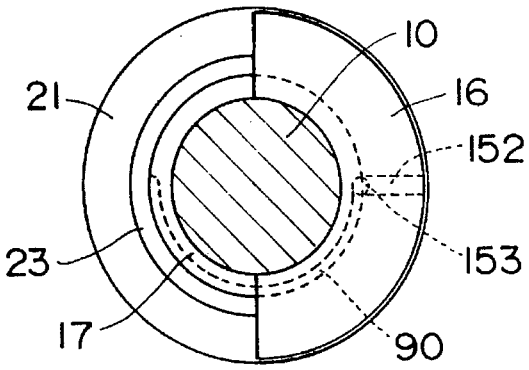

The centrifugal pump shown in FIG. 9 is constituted by securing the balance weight 16, which is provided with a radial hole 152 formed in the direction of the radius in such a manner that one of its ends opens into the external circumferential surface of the balance weight 16, an oil reservoir 154 that is formed in the lower side surface of the balance weight 16 to communicate with the trailing end of the spiral groove 90 and the communicating hole 153 which communicates between the other end of the radial hole 152 and the oil reservoir 154, to the drive shaft 10 in such a manner that there is a small clearance between the balance weight 16 and the upper end portion of the bearing portion 21*a*.

With this, when the drive shaft 10 rotates to rotate the balance weight 16, an outward force is applied to the lubricating oil inside the radial hole 152 due to the centrifugal force, to be discharged into the inner lubricating oil reservoir 144. As a result, the pressure in the communicating hole 153 and in the oil reservoir 154 becomes negative, which causes the pressure at the trailing end of the spiral groove 90 to become negative, to assist in the suction force of the spiral groove 90. In addition, the discharge force (centrifugal force) of the radial hole 152 increases as the rotation rate of the drive shaft 10 increases. Thus, the negative pressure at the trailing end of the spiral groove 90 also increases, increasing the suction force of the spiral groove.

As has been explained, according to the present invention, since a means for intake assistance which ensures that the lubricating oil in the oil space is induced into the spiral groove in correspondence to the rotation rate of the drive shaft is provided in the spiral groove which is formed on an inclination in the external circumferential surface of the drive shaft where it slides in contact with the main bearing with the leading end of the spiral groove in the direction of the rotation of the drive shaft opening into the oil space and its trailing end in the direction of the rotation opening into the lubricating oil reservoir to supply lubricating oil to the area where the drive shaft slides in contact with the main bearing with the rotation of the drive shaft, or alternatively, the spiral groove which is formed on an inclination in the external circumferential side surface of the drive shaft where it slides in contact with the main bearing with its front end in the direction of the rotation of the drive shaft opening into the oil space and its rear end in the direction of the rotation opening into the space formed with the oil cover which encloses the range of rotation of the balance weight that is secured to the drive shaft, the suction force of the spiral groove during high speed rotation is improved, making it possible to supply a sufficient quantity of lubricating oil to the main bearing during high speed rotation and achieving an improvement in the durability of the main bearing.

Also, since the means for intake assistance can be constituted by providing an oil induction hole which communicates between the orbiting space formed between the oscillating shaft and the bearing and the oil space with the intake port for the oil induction hole formed within the spiral groove near the leading end in the direction of the rotation of the drive shaft, the assistance for suction force of the spiral groove can be achieved with a simple structure, achieving the advantages described above while the production costs are reduced.

Moreover, since the means for intake assistance can be constituted with a centrifugal pump provided next to the trailing end of the spiral groove of the drive shaft, with this centrifugal pump comprising one radial groove formed in the direction of the radius in the lower side surface of a disk which is fitted to the drive shaft at a specific distance from the block, the end of which toward the center communicates with the trailing end of the spiral groove in the direction of the rotation of the drive shaft, or, alternatively, comprising at least one radial groove formed in the direction of the radius in the lower side surface of a disk which is fitted to the drive shaft at a specific distance from the block and a circular groove formed in the lower side surface of the disk, which communicates with the end of the radial groove toward the center and also communicates with the trailing end of the spiral groove of the drive shaft, the centrifugal pump can be formed with a reduced number of parts, achieving the advantages described earlier while reducing the production costs with simple machining.

Furthermore, since the centrifugal pump may be constituted with a radial groove formed in the direction of the radius of the lower side surface of the balance weight, which is secured to the drive shaft at a specific distance from the block, the end of which toward the center communicates with the trailing end of the spiral groove, or, alternatively, the centrifugal pump may be constituted with a radial hole formed in the direction of the radius of the balance weight, which is secured to the drive shaft at a specific distance from the block and a communicating hole that communicates between the end of the radial hole toward the center and the trailing end of the spiral groove, the structure can be simplified as in the previous cases and at the same time, because the machining is simple, a reduction in production costs can be achieved.

What is claimed is:

1. A scroll type compressor comprising:

a sealed case having a high pressure space;

a block having a through hole and being secured in said sealed case;

a main bearing positioned in said through hole of said block;

a drive unit mounted in said sealed case and having a rotary drive shaft which is rotatably mounted in said main bearing;

an orbiting shaft extending eccentrically from said drive shaft;

an orbiting scroll member having a bearing in which said orbiting shaft is inserted, said orbiting bearing and said orbiting shaft defining a bearing space;

a fixed scroll member secured to said block and being operably engaged with said orbiting scroll member;

a lubricating oil reservoir defined by an upper portion of said block and an interior surface of said sealed case, said reservoir being located within said high pressure space;

an oil space defined between said block and said main bearing and being in communication with said lubricating oil reservoir;

a spiral groove formed in an external surface of said drive shaft at an axial location thereof corresponding to said main bearing, and having a first end and a second end, wherein said first end is in fluid communication with said oil space and is the leading end relative to the direction of drive shaft rotation;

an oil intake opening formed in a sidewall of said drive shaft and communicating with said oil space;

an oil outlet opening formed in said orbiting shaft and communicating with said bearing space;

an oil induction passage fluidically communicating between said oil intake opening and said oil outlet opening to allow oil to flow from said oil space to said bearing space; and an oil intake assistance means for facilitating the flow of oil into said spiral groove.

2. The scroll type compressor as claimed in claim 1, wherein said intake assistance means comprises an extension of said spiral groove at said leading end of said spiral groove, and said oil intake opening is located in said extension.

3. The scroll type compressor as claimed in claim 1, wherein said intake assistance means comprises a centrifugal pump including:

a disk fixed on said drive shaft adjacent said block;

an opening formed in an external circumferential surface of said disk; and a radial groove formed in a surface of said disc and extending between said opening and said second end of said spiral groove.

4. The scroll type compressor as claimed in claim 1, wherein said intake assistance means comprises a centrifugal pump including:

a disc fixed on said drive shaft adjacent said block;

at least one opening formed in an external circumferential surface of said disc;

a circular groove formed in a surface of said disc and communicating with said second end of said spiral groove; and at least one radial groove formed in a surface of said disc and communicating between said at least one opening and said circular groove.

5. The scroll type compressor as claimed in claim 1, wherein said intake assistance means comprises a centrifugal pump including:

a balance weight secured to said drive shaft adjacent said block;

an opening formed in an external circumferential surface of said balance weight; and a radial groove communicating with said second end of said spiral groove and said opening.

6. The scroll type compressor as claimed in claim 1, wherein said intake assistance means comprises a centrifugal pump including:

a balance weight secured to said drive shaft adjacent said block;

an opening formed in an external circumferential surface of said balance weight;

a radial hole having an inner end and an outer end communicating with said external opening; and an axial hole communicating between said second end of said spiral groove and said inner end of said radial hole.

7. The scroll type compressor as claimed in claim 1, further comprising:

a balance weight secured to said drive shaft below said drive unit; and an oil cover surrounding said balance weight.

8. The scroll type compressor as claimed in claim 7, wherein said intake assistance means comprises an extension of said spiral groove at said leading end of said spiral groove, and said oil intake opening is located in said extension.

9. The scroll type compressor as claimed in claim 7, wherein said intake assistance means comprises a centrifugal pump including:

a disk fixed on said drive shaft adjacent said block;

an opening formed in an external circumferential surface of said disk; and a radial groove formed in a surface of said disc and extending between said opening and said second end of said spiral groove.

10. The scroll type compressor as claimed in claim 7, wherein said intake assistance means comprises a centrifugal pump including:

a disc fixed on said drive shaft adjacent said block:

at least one opening formed in an external circumferential surface of said disc;

a circular groove formed in a surface of said disc and communicating with said second end of said spiral groove; and at least one radial groove formed in a surface of said disc and communicating between said at least one opening and said circular groove.

11. The scroll type compressor as claimed in claim 7, wherein said balance weight includes an opening formed in an external circumferential surface thereof and a radial groove communicating between said second end of said spiral groove and said opening, wherein said opening and said radial groove form a centrifugal pump which constitutes said intake assistance means.

12. The scroll type compressor as claimed in claim 7, wherein said balance weight includes an opening formed in an external circumferential surface thereof, a radial hole having an inner end and an outer end communicating with said opening, and an axial hole communicating between said second end of said spiral groove and said inner end of said radial hole, wherein said opening, said radial hole and said axial hole form a centrifugal pump which constitutes said intake assistance means.

13. A scroll type compressor comprising:

a sealed case having a high pressure space;

a block having a through hole and being secured in said sealed case;

a main bearing positioned in said through hole of said block;

a drive unit mounted in said sealed case and having a rotary drive shaft engaged with said main bearing;

an orbiting shaft extending eccentrically from said drive shaft;

an orbiting scroll member having a bearing in which said orbiting shaft is inserted, said orbiting bearing and said orbiting shaft defining a bearing space;

a fixed scroll member secured to said block and being operably engaged with said orbiting scroll member;

a lubricating oil reservoir defined by an upper portion of said block and an interior surface of said sealed case, said reservoir being located within said high pressure space;

an oil space defined between said block and said main bearing and being in communication with said lubricating oil reservoir;

a spiral groove formed in an external surface of said drive shaft at an axial location thereof corresponding to said main bearing and having a first end and a second end, wherein said first end is in fluid communication with said oil space and is the leading end relative to the direction of drive shaft rotation;

an oil intake opening formed in a sidewall of said drive shaft and communicating with said oil space;

an oil outlet opening formed in said orbiting shaft and communicating with said bearing space;

an oil induction passage fluidically communicating between said oil intake opening and said oil outlet opening to allow oil to flow from said oil space to said bearing space; and a groove extension formed in said external surface of said drive shaft and extending from said first end of said spiral groove in the direction of rotation of said drive shaft.

14. The scroll type compressor as claimed in claim 13, wherein said groove extension is horizontal and said oil intake opening is located in said horizontal groove extension.

15. The scroll type compressor as claimed in claim 13, wherein said oil intake opening is located in said spiral groove and said groove extension is a continuation of said spiral groove past said oil intake opening.

16. A scroll type compressor comprising:

a sealed case having a high pressure space;

a block having a through hole and being secured in said sealed case;

a main bearing positioned in said through hole of said block;

a drive unit mounted in said sealed case and having a rotary drive shaft engaged with said main bearing;

an orbiting shaft extending eccentrically from said drive shaft;

an orbiting scroll member having a bearing in which said orbiting shaft is inserted, said orbiting bearing and said orbiting shaft defining a bearing space;

a fixed scroll member secured to said block and operably receiving said orbiting scroll member;

a lubricating oil reservoir defined by an upper portion of said block and an interior surface of said sealed case, said reservoir being located within said high pressure space;

an oil space defined between said block and said main bearing and being in communication with said lubricating oil reservoir;

a spiral groove formed in an external surface of said drive shaft at an axial location corresponding to said main bearing and having a first end and a second end, wherein said first end is in fluid communication with said oil space and is the leading end relative to the direction of drive shaft rotation;

an oil intake opening formed in a sidewall of said drive shaft and communicating with said oil space;

an oil outlet opening formed in said orbiting shaft and communicating with said bearing space;

an oil induction passage fluidically communicating between said oil intake opening and said oil outlet opening to allow oil to flow from said oil space to said bearing space; and a centrifugal pump fixed on said drive shaft adjacent said block, said pump having an inlet communicating with said second end of said spiral groove.

* * * * *